US007608156B2

(12) United States Patent
Ono et al.

(10) Patent No.: US 7,608,156 B2
(45) Date of Patent: Oct. 27, 2009

(54) HIGH STRENGTH COLD ROLLED STEEL SHEET AND METHOD FOR MANUFACTURING THE SAME

(75) Inventors: Yoshihiko Ono, Hiroshima (JP); Yasunobu Nagataki, Hiroshima (JP); Yasushi Tanaka, Hiroshima (JP); Kozo Harada, Aichi (JP); Hisanori Ando, Hiroshima (JP)

(73) Assignee: JFE Steel Corporation (JP)

( * ) Notice: Subject to any disclaimer, the term of this patent is extended or adjusted under 35 U.S.C. 154(b) by 247 days.

(21) Appl. No.: 10/549,164

(22) PCT Filed: Nov. 26, 2004

(86) PCT No.: PCT/JP2004/017990

§ 371 (c)(1),
(2), (4) Date: Sep. 14, 2005

(87) PCT Pub. No.: WO2005/054534

PCT Pub. Date: Jun. 16, 2005

(65) Prior Publication Data

US 2006/0169365 A1 Aug. 3, 2006

(30) Foreign Application Priority Data

Dec. 5, 2003 (JP) ..... 2003-407124

(51) Int. Cl.

| | |
|---|---|
| ***C22C 38/12*** | (2006.01) |
| ***C22C 38/26*** | (2006.01) |
| ***C22C 38/48*** | (2006.01) |
| ***C21D 8/00*** | (2006.01) |

(52) U.S. Cl. ..... 148/328; 148/330; 148/333; 148/334; 148/335; 148/336; 148/332; 148/651

(58) Field of Classification Search ..... 148/650–651, 148/320, 328, 603, 332–336; 420/127–128
See application file for complete search history.

(56) References Cited

U.S. PATENT DOCUMENTS 6,911,268 B2 * 6/2005 Takada et al. ..... 428/659

FOREIGN PATENT DOCUMENTS

| | | |
|---|---|---|
| EP | 0 816 524 A1 | 1/1998 |
| EP | 0 885 978 A1 | 12/1998 |
| EP | 1 146 132 A1 | 10/2001 |

(Continued)

*Primary Examiner*—Deborah Yee
(74) *Attorney, Agent, or Firm*—DLA Piper LLP (US)

(57) ABSTRACT

This disclosure relates to a high strength cold rolled steel sheet composed of ferrite grains having an average grain diameter of 10 μm or less, in which the average number per unit area of Nb(C, N) precipitates having a diameter of 50 nm or more is $7.0\times10^{-2}/\mu m^2$ or less, and a zone having a width of 0.2 to 2.4 μm and an average area density of NbC precipitates of 60% or less of that of the central portion of the ferrite grains is formed along grain boundaries of the ferrite grains, for example, the steel sheet consisting of 0.004 to 0.02% of C, 1.5% or less of Si, 3% or less of Mn, 0.15% or less of P, 0.02% or less of S, 0.1 to 1.5% of sol.Al, 0.001 to 0.007% of N, 0.03 to 0.2% of Nb, by mass, and the balance of Fe and inevitable impurities. The steel sheet is most preferably used for automobile panel parts since it has the TS of 340 MPa or more and the superior surface strain resistance and press formability.

12 Claims, 2 Drawing Sheets

FOREIGN PATENT DOCUMENTS

| | | | |
|---|---|---|---|
| EP | 1 318 205 | A1 | 6/2003 |
| JP | 55-58347 | A | 5/1980 |
| JP | 02-80539 | A | 3/1990 |
| JP | 05-287547 | A | 11/1993 |
| JP | 06-330180 | A | 11/1994 |

* cited by examiner

HIGH STRENGTH COLD ROLLED STEEL SHEET AND METHOD FOR MANUFACTURING THE SAME

TECHNICAL FIELD

This disclosure relates to a high strength cold rolled steel sheet used for automobiles, home appliances, or the like, in particular, to a high strength cold rolled steel sheet having superior press formability and a tensile strength TS of 340 MPa or more, and to a manufacturing method thereof.

BACKGROUND ART

Heretofore, for automobile panel parts having a complicated shape such as a side panel or a door inner panel, which are difficult to be press formed, interstitial free (IF) cold rolled steel sheets (270E, F) having superior deep drawability and stretchability and a TS of around 270 MPa, have been widely used.

In recent years, due to increasing needs of lighter weight and higher strength of automobile bodies, a high strength cold rolled steel sheet having a TS of 340 MPa or more, and particularly, 390 MPa or more, has been progressively applied to those parts which are difficult to be press formed. In addition, as is the case described above, there has also been a trend to apply a higher strength cold rolled steel sheet to inner parts or the like, in which a high strength cold rolled steel sheet has been used, so as to further reduce automobile weight by decreasing the number of reinforcement parts or by decreasing the thickness thereof.

However, when the strength of the high strength cold rolled steel sheet used in automobile panels is further increased, and the thickness thereof is further decreased, the occurrence of surface strain is remarkably increased due to the increase in yield strength YS, the decrease in work hardening coefficient n value, and the decrease in the thickness. This surface strain is a defect such as an undulation or a wrinkle brought out on a surface of steel sheet after press forming and deteriorates dimensional precision or appearance of press formed panels. Therefore, when a high strength cold rolled steel sheet is applied to parts which are difficult to be press formed such as automobile panel parts, the steel sheet must have superior resistance to surface strain and excellent stretchability, and more particularly, the steel sheet having a YS of 270 MPa or less and a $n_{1-10}$ of 0.20 or more is preferably desired. Here, the $n_{1-10}$ is a work hardening coefficient calculated from the stresses at strains of 1% and 10% of a stress-strain curve obtained from a tensile test.

To decrease the yield ratio YR (=YS/TS), a method has been well known, in which a Ti or Nb added steel having the amount of C and N decreased as small as possible is hot rolled and coiled at a temperature of 680° C. or more to decrease the number of precipitates containing Ti or Nb and thereby to promote grain growth at annealing after cold rolling. In addition, in Japanese Unexamined Patent Application Publication No. 6-108155 and Japanese Patent No. 3291639, methods for promoting grain growth have been disclosed in which the amounts of C and S of Ti added steel are controlled to bring about Ti(C, S) precipitates in order to suppress the formation of fine TiC precipitates.

The above-mentioned methods are effective for a cold rolled mild steel sheet having a TS of approximately 270 MPa. However, when the grain growth is promoted, the TS is also decreased simultaneously as the YS is decreased, and therefore the methods are not always effective for a high strength cold rolled steel sheet having a TS of 340 MPa or more. That is, since the decrease in TS must be compensated for by addition of alloying elements such as Si, Mn, or P, problems may arise in that a manufacturing cost is increased, surface defects take place, a YS of 270 MPa or less is not obtained, and the like. For example, when the steel sheet is strengthened by addition of Si, Mn, and P, accompanied by the grain growth of approximately 10 μm to 20 μm in grain size, the steel sheet can only be obtained having a YS approximately 10 MPa smaller than that of a conventional high strength cold rolled steel sheet, and in addition, the resistance to the occurrence of orange peel and the anti-secondary work embrittlement of the steel sheet also deteriorates.

On the other hand, in Japanese Unexamined Patent Application Publication Nos. 2001-131681, 2002-12943, and 2002-12946, methods have been disclosed in which, without promoting grain growth, the YS is decreased and the high n value is obtained. According to the methods described above, the amount of C is controlled to approximately 0.004 to 0.02%, which is larger than that of a conventional ultra low carbon steel sheet, and grain refinement and precipitation strengthenings are positively applied in order to decrease the YS by approximately 20 MPa than that of a conventional ultra low carbon IF steel sheet.

However, when a high strength cold rolled steel sheet having a TS of approximately 390 MPa or 440 MPa is manufactured by the methods described above, the YS exceeds 270 MPa, and it becomes difficult to perfectly suppress the occurrence of the surface strain.

It could therefore be advantageous to provide a high strength cold rolled steel sheet having a TS of 340 MPa or more, in which YS≦270 MPa and $n_{1-10}$≧0.20 are satisfied, and a manufacturing method thereof, the steel sheet having superior surface strain resistance and press formability.

SUMMARY

We thus provide a high strength cold rolled steel sheet composed of ferrite grains having an average grain diameter of 10 μm or less, in which the average number per unit area (hereinafter referred to as "average area density") of Nb(C, N) precipitates having a diameter of 50 nm or more in the ferrite grains is $7.0\times10^{-2}/\mu m^2$ or less, and a zone (hereinafter referred to as "PFZ") having a width of 0.2 to 2.4 μm and an average area density of NbC precipitates of 60% or less of that of the central portion of the ferrite grains is formed along grain boundaries of the ferrite grains.

This high strength cold rolled steel sheet can be obtained, for example, by a high strength cold rolled steel sheet consisting of 0.004 to 0.02% of C, 1.5% or less of Si, 3% or less of Mn, 0.15% or less of P, 0.02% or less of S, 0.1 to 1.5% of sol.Al, 0.001 to 0.007% of N, 0.03 to 0.2% of Nb, by mass, and the balance of Fe and inevitable impurities.

In addition, this high strength cold rolled steel sheet can be manufactured by a manufacturing method comprising the steps of: hot rolling a steel slab having the composition described above into a hot rolled steel sheet after heating the steel slab at a heating temperature SRT which satisfies the following equations (3) and (4); and pickling and cold rolling the hot rolled steel sheet, followed by annealing within a temperature range of a ferrite phase above the recrystallization temperature.

$$SRT \leqq 1350^\circ C. \quad (3), \text{ and}$$

$$1050^\circ C. \leqq SRT \leqq \{770+([sol.Al]-0.085)^{0.24}\times820\}^\circ C. \quad (4),$$

where [sol.Al] represents the amount of sol.Al (mass %).

DETAILED DESCRIPTION

1. Control of Precipitates Containing Nb

Figure 1:
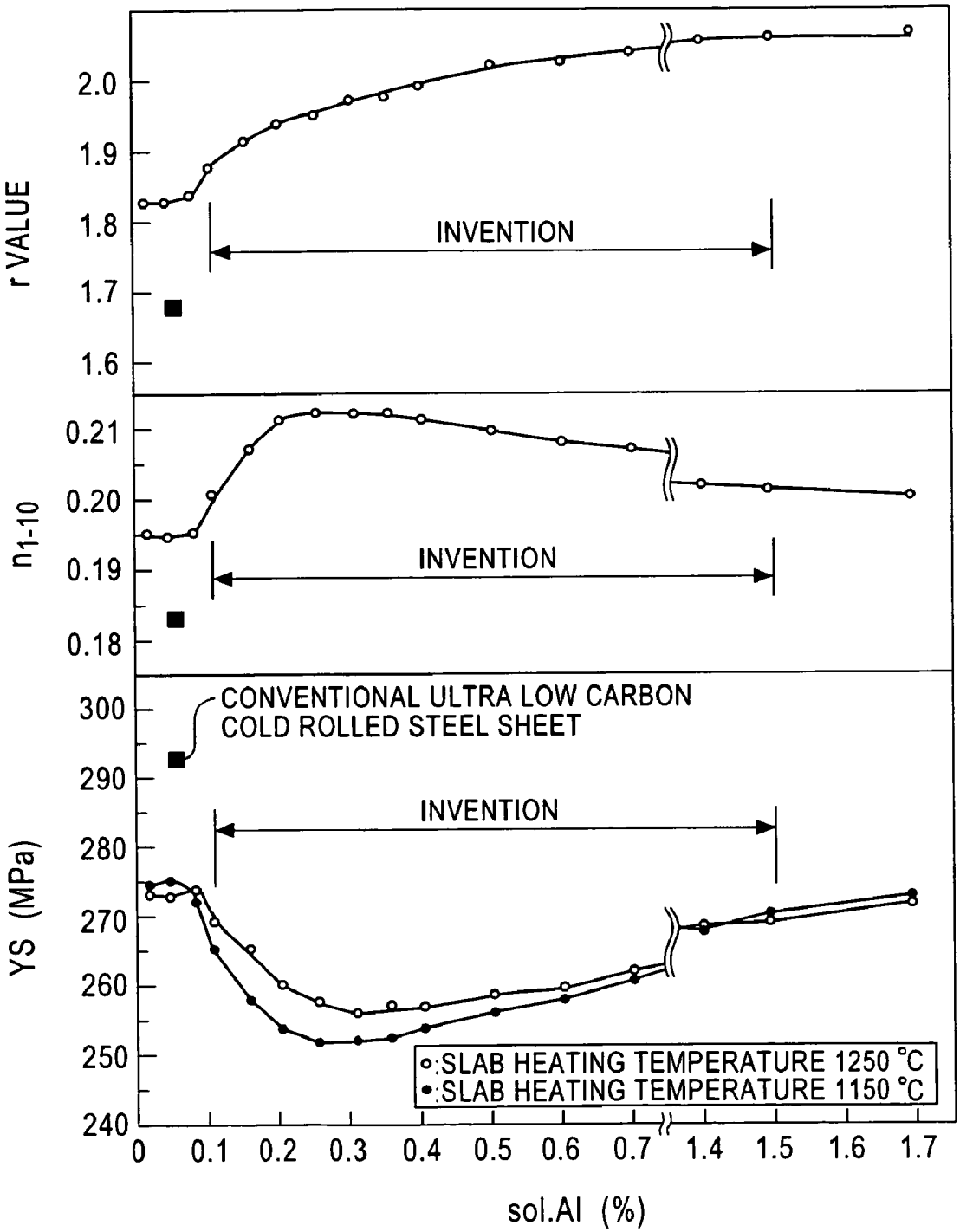
FIG. 1 shows the relationship between amount of sol.Al and YS, n value and r value.

We investigated how to decrease the YS of a high strength cold rolled steel sheet and clarified that a high strength cold rolled steel sheet having a YS of 270 MPa or less, an $n_{1-10}$ of 0.20 or more, and a TS of 340 MPa or more can be obtained when the steel sheet is composed of ferrite grains having an average grain diameter of 10 μm or less, in which the average area density of Nb(C, N) precipitates having a diameter of 50 nm or more is controlled to $7.0\times10^{-2}/\mu m^2$ less, and a zone having a width of 0.2 to 2.4 μm and an average area density of NbC precipitates of 60% or less of that of the central portion of the ferrite grains is formed along grain boundaries of the ferrite grains.

The Nb(C, N) precipitates having a diameter of 50 nm or more are formed at hot rolling to have a diameter of approximately 50 nm, do not become larger even at annealing after cold rolling, and are uniformly dispersed in the ferrite grains.

On the other hand, the NbC precipitates at the center of the ferrite grains are formed at annealing, the diameter of which is approximately 10 nm, and the NbC precipitates in the PFZ are formed in such a way that fine precipitates having a diameter of approximately 2 nm uniformly formed at hot rolling are coarsened to have a diameter of approximately 50 nm by Ostwald-ripening.

The average area density of NbC and Nb(C, N) precipitates was measured as described below using a transmission electron microscope at a magnification of 5610 times and an accelerating voltage of 300 kV.

As to the Nb(C, N) precipitates having a diameter of 50 nm or more uniformly formed in the ferrite grains, arbitrary 50 portions therein were selected, the number of Nb(C, N) precipitates existing in a circle of 2 μm in diameter centered at each of the portions was measured to calculate the number per unit area (area density), and finally the average was obtained therefrom.

The average area density of NbC precipitates in the central portion of the ferrite grains was obtained in the same manner as described above.

As to the NbC precipitates in the PFZ, arbitrary 50 precipitates coarsened by Ostwald-ripening were selected. For each of the NbC precipitates, a circle inscribed with the NbC and the grain boundary adjacent to the NbC was described, the number of NbC precipitates existing in the circle was measured to obtain the area density, and the average of the area density was then calculated.

The width of the PFZ was obtained as the average of the diameters of the above 50 circles.

The high strength cold rolled steel sheet has the central portion of ferrite grain in which fine NbC precipitates having the diameter of approximately 10 nm are formed at a high density and the PFZ along the grain boundary in which coarse NbC precipitates having the diameter of approximately 50 nm are formed at a low density. It is considered that a low YS and a high n value can be obtained because the soft PFZ is deformed by a low stress at the initial stage of the plastic deformation, and that a high TS can be obtained due to the hard central portion of ferrite grain.

As previously mentioned, the fine NbC precipitates having a diameter of approximately 2 nm are uniformly formed at the hot rolling and coarsen into the precipitates having the diameter of approximately 50 nm on the grain boundary of recrystallized ferrite grains at annealing in a continuous annealing line (CAL) or a continuous galvanizing line (CGL) after cold rolling. Therefore, the PFZ is believed to be formed due to promotion of grain boundary migration.

In order not to make ferrite grains extremely coarse, the recrystallized grains should be preferably as fine as possible, and the PFZ can be more effectively formed.

2. Chemical Composition

As a high strength cold rolled steel sheet, for example, there may be mentioned a cold rolled steel sheet consisting of 0.004 to 0.02% of C, 1.5% or less of Si, 3% or less of Mn, 0.15% or less of P, 0.02% or less of 5, 0.1 to 1.5% of sol.Al, 0.001 to 0.007% of N, 0.03 to 0.2% of Nb, by mass, and the balance of Fe and inevitable impurities. C, Nb, and sol.Al play a very important role in the control of NbC and Nb(C, N) precipitates, and the amounts of C, Nb, and sol.Al must be controlled as follows.

C: Since C is combined with Nb, C plays an important role in the control of NbC and Nb(C, N) precipitates. The amount of C is set to 0.004 to 0.02%, preferably 0.004 to 0.01%.

Nb: In order to control the NbC and Nb(C, N) precipitates, the amount of Nb is set to 0.03% or more. However, when the amount of Nb exceeds 0.2%, the increase in the rolling load at the hot rolling and the cold rolling causes the decrease in productivity or the increase in cost. Therefore, the amount of Nb is set to 0.2% or less.

In order to increase r value, $([Nb]/[C])\times(12/93)\geqq1$ is preferably satisfied, and the $([Nb]/[C])\times(12/93)$ is more preferably 1.5 to 3.0.

sol.Al: Even when the amount of C is controlled to 0.004 to 0.02%, and the amount of Nb is controlled to 0.03 to 0.2%, Ys of 270 MPa or less may not always be obtained in some cases. It is considered to be due to coarse Nb(C, N) precipitates formed at hot rolling. As the above-mentioned, it is believed that the coarse Nb(C, N) precipitates having the diameter of approximately 50 nm which is formed at the hot rolling have difficulties to be coarsened by Ostwald-ripening at annealing because of the large size and the smaller solubility in ferrite than that of NbC precipitates, and suppression of the PFZ formation leads to suppression of the decrease in YS.

Then, we investigated a method for the formation of NbC precipitates effective for forming the PFZ by suppressing coarse Nb(C, N) precipitates having a diameter of 50 nm or more, and found that the addition of 0.1% or more of sol.Al is effective.

It has been believed that N is combined with Al to form AlN. However, in steel containing 0.004% or more of C and 0.03% or more of Nb, precipitation of Nb(C, N) takes place at finish rolling before AlN starts to precipitate. When the amount of Al is increased to 0.1% or more so that AlN is precipitated before Nb(C, N) is precipitated, the precipitation of NbC effective for forming the PFZ can proceed.

FIG. 1 shows the relationship between the amount of sol.Al and YS, n value and r value.

The results shown in FIG. 1 were obtained by investigating YS, r value, and n value of cold rolled steel sheets containing 0.0060% of C, 0 to 0.45% of Si, 1.5 to 2% of Mn, 0.02% of P, 0.002% of S, 0.003% of N, 0.0005% of B, 0.11% of Nb, and 0.01 to 1.7% of sol.Al, which are heated at 1150° C. and 1250° C., followed by the hot rolling to 3 mm thick in the γ region and coiling at 560° C., and subsequently cold rolled to 0.8 mm thick, followed by annealing at 820° C. for 80 seconds. Since the increases in TS by the addition of one percent of Si, Mn, and sol.Al were 86 MPa, 33 MPa, and 32.5 MPa, respectively, the amounts of Si, Mn, and Al were controlled so as to obtain a constant TS of approximately 440 MPa. That is, ([Si]+[Mn]/2.6+[sol.Al]/2.6) was controlled to 1.25%. Here, [M] represents the amount of element M (mass %).

YS, r value, and n value are also examined in a conventional ultra low carbon cold rolled steel sheet manufactured under the same conditions as described above using a steel containing 0.0020% of C, 0.75% of Si, 2% of Mn, 0.02% of P, 0.002% of S, 0.003% of N, 0.0005% of B, 0.015% of Nb, and 0.03% of Ti.

The cold rolled steel sheets containing 0.004% or more of C and 0.03% or more of Nb have lower YS, higher n value, and higher r values than the conventional ultra low carbon cold rolled steel sheet. In particular, when the amount of sol.Al is 0.1 to 1.5%, YS becomes 270 MPa or less and $n_{1-10}$ becomes 0.20 or more. In addition, when the amount of sol.Al is 0.2 to 0.6%, the YS is further decreased to 260 MPa or less in both cases of heating temperatures of 1250 and 1150° C. The ferrite grains were sufficiently fine as is the case in which the amount of sol.Al is 0.1% or less.

When the amount of sol.Al is less than 0.1%, a large number of Nb(C, N) precipitates having a diameter of 50 nm or more, which inhibit the formation of the PFZ, are observed. On the other hand, when the amount of sol.Al is 0.1 to 1.5%, the coarse Nb(C, N) precipitates are remarkably decreased to an average area density of 0 to $7.0\times10^{-2}/\mu m^2$, and the PFZ is remarkably formed.

The reason why the r value is remarkably increased when the amount of sol.Al is controlled to 0.1% or more is not clear. It is, however, inferred that Al influences the formation of a deformation band at cold rolling or on the amount of solute C.

Si: Si is an element for the solid solution strengthening, which may be added when it is necessary. However, the amount of Si which exceeds 1.5% deteriorates the ductility and the anti-secondary work embrittlement, and increases the YS. The amount of Si is set to 1.5% or less. In addition, since the addition of Si deteriorates the conversion treatment properties of a cold rolled steel sheet and appearance of a hot dip galvanized steel sheet, the amount of Si is preferably set to 0.5% or less. In order to strengthen the steel sheet, the amount of Si is preferably set to 0.003% or more.

Mn: Since Mn is also an element for solid solution strengthening and an element for preventing red shortness, Mn may be added when it is necessary. However, when the amount of Mn exceeds 3% a decrease in ductility and an increase in YS occur. The amount of Mn is set to 3% or less. To obtain the superior appearance of the galvanized steel sheet, the amount of Mn is preferably set to 2% or less. The amount of Mn is preferably set to 0.1% or more for the solid solution strengthening.

P: P is an effective element for strengthening the steel. However, excessive addition of P deteriorates the anti-secondary work embrittlement and ductility, and causes an increase in YS. Therefore, the amount of P is set to 0.15% or less. To prevent the deterioration of alloying treatment properties and adhesion failure of coating of the galvanized steel sheet, the amount of P is preferably set to 0.1% or less. The amount of P is preferably set to 0.01% or more to increase the strength of the steel sheet.

S: S exists as a sulfide in the steel sheet. Since an excessive amount of S decreases ductility, the amount of S is set to 0.02% or less. 0.004% or more of S is desirable for the descaling preferably set to, and 0.01% or less of S is favorable for the ductility.

N: Since N is necessary to precipitate as AlN with the addition of 0.1 to 1.5% of sol.Al, the amount of N is set to 0.007% or less. The amount of N is preferably decreased to as little as possible. However, since the amount of N can not be decreased to less than 0.001% by the steel smelting process, the amount of N is set to 0.001% or more.

The balance is Fe and inevitable impurities.

In addition to the elements described above, at least one element selected from the group consisting of 0.0001 to 0.003% of B, 0.5% or less of Cu, 0.5% or less of Ni, 0.3% or less of Mo, 0.5% or less of Cr, 0.04% or less of Ti, 0.2% or less of Sb, and 0.2% or less of Sn is preferably added for the following reasons.

B: The amount of B is set to 0.0001% or more in order to improve the anti-secondary embrittlement. When the amount of B exceeds 0.003%, the effect saturates, and the rolling load at hot rolling is increased. Therefore, the amount of B is set to 0.0001 to 0.003%.

Cu, Ni, Mo, and Cr: In order to increase the TS, the anti-secondary work embrittlement, and the r value, 0.5% or less of Cu, 0.5% or less of Ni, 0.3% or less of Mo, and 0.5% or less of Cr may be added. Cu, Cr, and Ni are the expensive elements, and when the amount of each element exceeds 0.5%, the surface appearance deteriorates. Although Mo increases the TS without decreasing the anti-secondary work embrittlement, the amount of Mo exceeding 0.3% increases the YS. When Cu, Cr, and Ni are added, the amount of each element is preferably set to 0.03% or more. When Mo is added, the amount of Mo is desirably set to 0.05% or more. When Cu is added, Ni is preferably added with the same amount as Cu.

Ti: To improve the r value, 0.04% or less of Ti may be added. The amount of Ti exceeding 0.04% increases coarse precipitates containing Ti, which lead to a decrease in the TS and prevention of a decrease in the YS by suppressing AlN precipitation. When Ti is added, the amount of Ti is preferably set to 0.005% or more.

Sb and Sn: To improve the surface appearance, the coating adhesion, the fatigue resistance, and the toughness of the galvanized steel sheet, 0.2% or less of Sb and 0.2% or less of Sn are effectively added so that $0.002 \leqq [Sb]+\frac{1}{2}\times[Sn] \leqq 0.2$ is satisfied. [Sb] and [Sn] represent the amounts of Sb and Sn (mass %), respectively. Since the addition of Sb and Sn prevents surface nitridation or oxidation at slab heating, at coiling after hot rolling, at annealing in a CAL or a CGL, or at additional intermediate annealing, the coating adhesion is improved in addition to the suppression of the irregular coating. Furthermore, since adhesion of zinc oxides to the steel sheet in a coating bath can be prevented, the surface appearance of the galvanized steel sheet is also improved. When the amounts of Sb and Sn exceed 0.2%, they deteriorate the coating adhesion and the toughness of the galvanized steel sheet.

3. Manufacturing Method

The high strength cold rolled steel sheet can be manufactured by a manufacturing method comprising the steps of: hot rolling a steel slab having a selected chemical composition into a hot rolled steel sheet after heating the steel slab at a heating temperature SRT which satisfies the following equations (3) and (4); and pickling and cold rolling the hot rolled steel sheet, followed by annealing within a temperature range of a ferrite phase above the recrystallization temperature.

$$SRT \leqq 1350°\ C. \quad (3), \text{ and}$$

$$1050°\ C. \leqq SRT \leqq \{770+([sol.Al]-0.085)^{0.24}\times820\}°\ C. \quad (4),$$

where [sol.Al] represents the amount of sol.Al (mass %).

As shown in FIG. 1, when the amount of sol.Al is 0.1 to 0.6%, the lower YS can be obtained at the heating temperature SRT of 1150° C. as compared with that of 1250° C.

The relation between the amount of sol.Al and SRT and YS was investigated by using the cold rolled steel sheets shown in FIG. 1.

Figure 2:
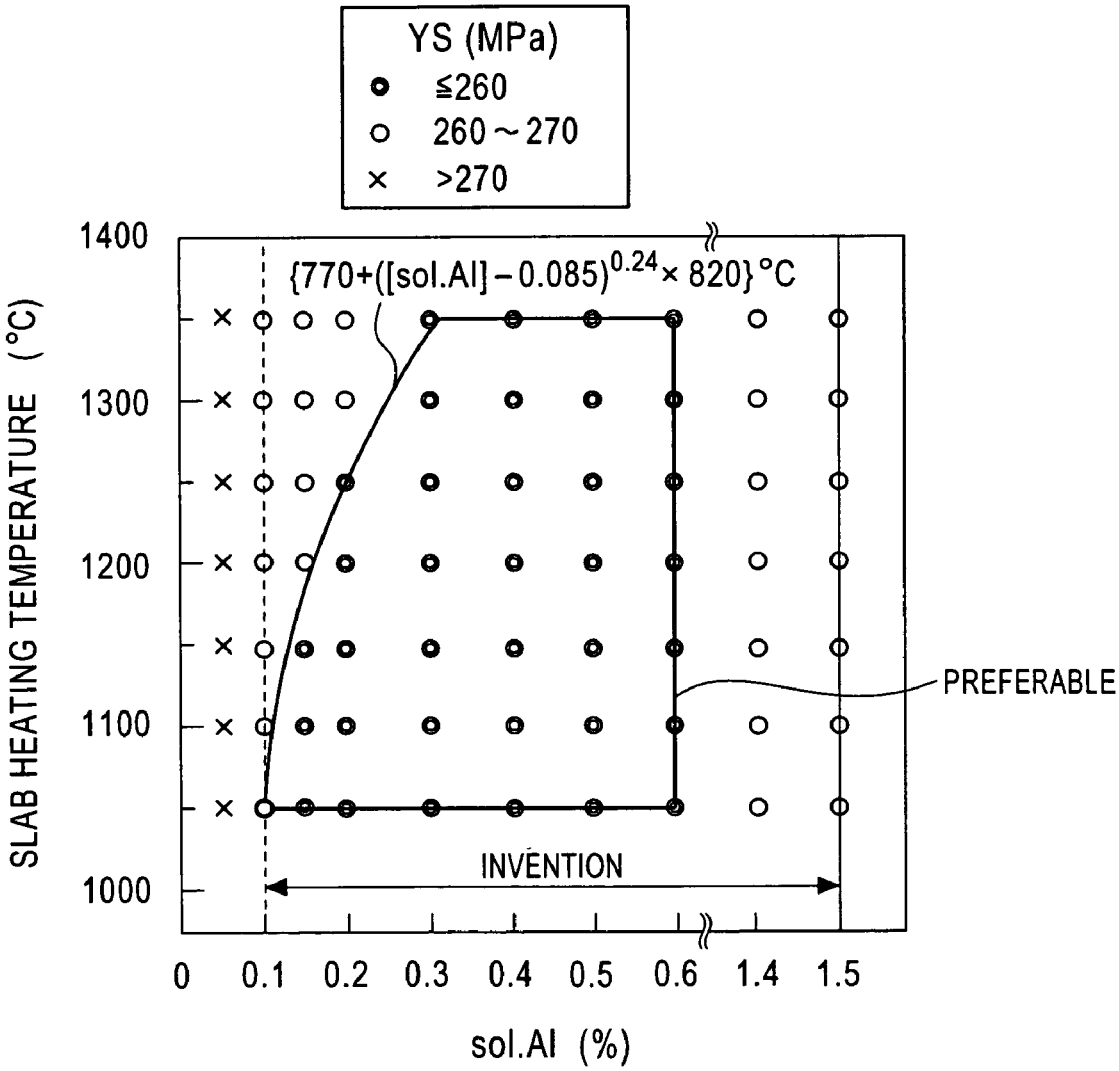
FIG. 2 shows the relationship between amount of sol.Al and slab heating temperature and YS.

As shown in FIG. 2, when the amount of sol.Al is 0.1 to 0.6%, and SRT≦{770+([sol.Al]−0.085)$^{0.24}$×820}° C. is satisfied, the low YS such as 260 MPa or less can be obtained. It is believed to be caused by the suppression of Nb(C, N) precipitation at hot rolling, accompanied by the suppression of AlN dissolution at heating by controlling the SRT. Fine ferrite grains having a grain diameter of 10 μm or less were obtained.

To obtain the superior surface quality, the scales formed at slab heating and at hot rolling should be preferably sufficiently removed. Heating with a bar heater at hot rolling may also be performed.

The coiling temperature after hot rolling influences formation of the PFZ and the r value. To effectively form the PFZ, fine NbC must be precipitated, and to obtain a high r value, the amount of solute C must be sufficiently decreased. In view of the effective formation of the PFZ and the high r value, the coiling temperature is preferably set to 480 to 700 C.°, more preferably 500 to 600 C.°.

The coiling temperature after hot rolling has influences on the formation of PFZ and the r value. In order to effectively form the PFZ, fine NbC must be precipitated, and in order to obtain a high r value, the amount of solute C must be sufficiently decreased. In view of the effective formation of PFZ and the high r value, the coiling temperature is preferably set to 480 to 700° C., more preferably 500 to 600° C.

The high cold rolling reduction is desirable. However, a cold rolling reduction which exceeds 85% increases the rolling load, so that the productivity decreases. Therefore, the cold rolling reduction is preferably 85% or less.

A high annealing temperature promotes the precipitation of coarser NbC existing in the vicinity of grain boundary, which causes the low YS and the high n value. Therefore, the annealing temperature is preferably set to 820 C.° or more. When the annealing temperature is lower than the recrystallization temperature, the sufficiently low YS and the high n value can not be obtained. Therefore, the annealing temperature must be at least not less than the recrystallization temperature. However, when the annealing temperature exceeds the Ac1 transformation temperature, ferrite grains become very fine by the ferrite transformation from the austenite, which leads to increase the YR. Therefore, the annealing temperature must be the temperature of the Ac1 transformation temperature or less.

When the annealing time is increased, grain boundary migration occurs more significantly to promote the formation of the PFZ. Therefore, the soaking time is preferably set to 40 seconds or more.

A cold rolled steel sheet after annealing may be galvanized by electrogalvanizing or hot dip galvanizing. The excellent press formability can also be obtained in the galvanized steel sheet where pure zinc coating, alloy zinc coating, and zinc-nickel alloy coating may be applied. Even when the organic film is deposited after the coating, the superior press can also be obtained.

Example 1

Several types of steel A to V having the chemical compositions listed in Table 1 were smelt and continuously cast into the slabs having a thickness of 230 mm. These slabs were heated to 1090 to 1325° C. and hot rolled to 3.2 mm thick under the hot rolling conditions listed in Table 2. These hot rolled steel sheets were cold rolled to 0.8 mm thick, followed by annealing in a continuous annealing line (CAL), a hot dip galvanizing line (CGL), or a box annealing furnace (BAF) under the annealing conditions shown in Table 2, and subsequently, temper rolling with the elongation of 0.5%.

The hot dip zinc coating was performed at 460° C. in the CGL, followed by the alloying treatment of the coated layer at 500° C. in an in-line alloying furnace. The amount of the coating per one surface was 45 g/m$^2$.

The tensile tests were performed using JIS No. 5 test pieces cut from the direction of 0°, the direction of 45° and the direction of 90° to the rolling direction, respectively. The averages of YS, $n_{1-10}$, r value, and TS were obtained by the following equation, respectively. The average V=([V0]+2[V45]+[V90])/4, where [V0], [V45] and [V90] show the value of the properties obtained in the direction of 0°, 45° and 90° to the rolling direction, respectively.

The ferrite grain diameter was measured by the point-counting method in the rolling direction, the thickness direction, and the direction of 45° to the rolling direction at the cross section parallel to the rolling direction, and the average of the ferrite grain sizes was obtained. The sizes of NbC and Nb(C, N) and the average area density thereof were obtained by the method previously mentioned.

The results are shown in Table 2.

Samples Nos. 1 to 19 have the YS of 270 MPa or less, the $n_{1-10}$ of 0.20 or more, and the high r value of 1.8 or more. In particular, the samples Nos. 2 to 6, 9 to 11, 15 to 17, and 19 have the YS of 260 MPa or less because the amounts of sol.Al are 0.1 to 0.6% and the temperature are within this disclosure. In the case of our samples, the average area density of coarse Nb(C, N) precipitates having a diameter of 50 nm or more, which prevents the formation of the PFZ, is 7.0×10$^{-2}$/μm$^2$ or less, and the PFZ having a width of 0.2 to 2.4 μm was formed in the vicinity of the ferrite grain boundary.

On the other hand, samples Nos. 20 to 27 of the comparative examples have the high YS and the low n value because the average area density of coarse Nb(C, N) precipitates having a diameter of 50 nm or more or the width of the PFZ is out of this disclosure. Sample No. 20 in which the amount of sol.Al is small has the YS of more than 270 MPa, then value of less than 0.20, and the r value of less than 1.8. Sample No. 21 in which the amount of sol.Al is excessive has the YS of more than 270 MPa and the n value of less than 0.20. Samples Nos. 23, 24, 25, and 26 in which C, Si, Mn, and P are out of our range have the YS of excessively larger than 270 MPa. Sample No. 27 in which the amount of Nb is small has then value of less than 0.20 and the excessively low r value.

Sample No. 22 as the conventional ultra low carbon high strength cold rolled steel sheet has the YS of much larger than 270 MPa, and the n value of less than 0.20.

In each of samples Nos. 1 to 19, the ferrite grains are fine having a diameter of less than 10 μm as compared with that of sample No. 22 of the conventional example, 11.4 μm. Therefore, each of samples Nos. 1 to 19 has the superior resistance to the occurrence of the orange peel and the anti-secondary work embrittlement.

TABLE 1

(mass %)

| STEEL | C | Si | Mn | P | S | sol. Al | N | Nb | B | OTHERS | Nb/C | REMARKS |
|---|---|---|---|---|---|---|---|---|---|---|---|---|
| A | 0.0065 | 0.17 | 1.7 | 0.052 | 0.003 | 0.12 | 0.0026 | 0.095 | — | — | 1.9 | WITHIN THE PRESENT INVENTION |
| B | 0.0067 | 0.17 | 1.6 | 0.050 | 0.005 | 0.28 | 0.0023 | 0.101 | — | — | 1.9 | WITHIN THE PRESENT INVENTION |
| C | 0.0064 | 0.13 | 1.6 | 0.037 | 0.002 | 0.75 | 0.0022 | 0.103 | — | — | 2.1 | WITHIN THE PRESENT INVENTION |
| D | 0.0064 | 0.10 | 1.6 | 0.022 | 0.002 | 1.20 | 0.0014 | 0.098 | — | — | 2.0 | WITHIN THE PRESENT INVENTION |
| E | 0.0043 | 0.003 | 0.14 | 0.013 | 0.001 | 0.21 | 0.0026 | 0.075 | — | — | 2.3 | WITHIN THE PRESENT INVENTION |
| F | 0.0055 | 0.05 | 0.85 | 0.045 | 0.004 | 0.21 | 0.0026 | 0.075 | — | — | 1.8 | WITHIN THE PRESENT INVENTION |
| G | 0.0097 | 0.06 | 1.9 | 0.035 | 0.003 | 0.75 | 0.0025 | 0.130 | — | — | 1.7 | WITHIN THE PRESENT INVENTION |
| H | 0.0040 | 0.25 | 1.2 | 0.068 | 0.006 | 0.35 | 0.0016 | 0.043 | — | — | 1.4 | WITHIN THE PRESENT INVENTION |
| I | 0.0155 | 0.10 | 0.6 | 0.057 | 0.004 | 0.34 | 0.0034 | 0.162 | — | — | 1.3 | WITHIN THE PRESENT INVENTION |
| J | 0.0052 | 0.25 | 1.6 | 0.041 | 0.004 | 0.52 | 0.0034 | 0.081 | 0.0002 | — | 2.0 | WITHIN THE PRESENT INVENTION |
| K | 0.0055 | 0.25 | 1.6 | 0.042 | 0.005 | 0.51 | 0.0024 | 0.094 | 0.0018 | — | 2.2 | WITHIN THE PRESENT INVENTION |
| L | 0.0068 | 0.18 | 1.4 | 0.051 | 0.005 | 0.30 | 0.0021 | 0.102 | 0.0004 | Cu: 0.2, Ni: 0.2 | 1.9 | WITHIN THE PRESENT INVENTION |
| M | 0.0080 | 0.18 | 1.3 | 0.047 | 0.001 | 0.30 | 0.0022 | 0.099 | 0.0003 | Cr: 0.2, Mo: 0.3, Ti: 0.01 | 1.6 | WITHIN THE PRESENT INVENTION |
| N | 0.0077 | 0.18 | 1.7 | 0.050 | 0.005 | 0.30 | 0.0037 | 0.103 | 0.0004 | Sb: 0.01, Sn: 0.003 | 1.7 | WITHIN THE PRESENT INVENTION |
| O | 0.0067 | 0.25 | 1.9 | 0.042 | 0.005 | 0.045 | 0.0029 | 0.101 | — | — | 1.9 | OUT OF THE PRESENT INVENTION |
| P | 0.0067 | 0.01 | 1.9 | 0.005 | 0.005 | 1.62 | 0.0028 | 0.105 | — | — | 2.0 | OUT OF THE PRESENT INVENTION |
| Q | 0.0018 | 0.25 | 2.4 | 0.044 | 0.008 | 0.03 | 0.0025 | 0.024 | — | — | 1.7 | OUT OF THE PRESENT INVENTION |
| R | 0.0250 | 0.10 | 1.8 | 0.040 | 0.006 | 0.23 | 0.0025 | 0.200 | — | — | 1.0 | OUT OF THE PRESENT INVENTION |
| S | 0.0055 | 1.70 | 0.3 | 0.005 | 0.002 | 0.15 | 0.0025 | 0.070 | — | — | 1.6 | OUT OF THE PRESENT INVENTION |
| T | 0.0050 | 0.01 | 3.5 | 0.010 | 0.004 | 0.18 | 0.0022 | 0.070 | — | — | 1.8 | OUT OF THE PRESENT INVENTION |
| U | 0.0056 | 0.01 | 0.7 | 0.160 | 0.001 | 0.19 | 0.0024 | 0.065 | — | — | 1.5 | OUT OF THE PRESENT INVENTION |
| V | 0.0045 | 0.15 | 1.7 | 0.060 | 0.004 | 0.25 | 0.0020 | 0.024 | — | — | 0.7 | OUT OF THE PRESENT INVENTION |

UNDERLINED: OUT OF THE PRESENT INVENTION

TABLE 2

| SAMPLE NO. | STEEL NO. | {770 + ([sol. Al] − 0.085)$^{0.24}$ × 820} (° C.) ※ | HOT ROLLING CONDITIONS SRT (° C.) | HOT ROLLING CONDITIONS CT (° C.) | ANNEALING CONDITIONS AT (° C.) | ANNEALING CONDITIONS LINE | MECHANICAL PROPERTIES YS (Mpa) | MECHANICAL PROPERTIES $n_{1-10}$ | MECHANICAL PROPERTIES r VALUE | MECHANICAL PROPERTIES TS (Mpa) | GRAIN DIAMETER (μm) | WIDTH OF PFZ (μm) | AREA DENSITY OF Nb (C, N) OF 50 nm OR MORE (/μm$^2$) | REMARKS |
|---|---|---|---|---|---|---|---|---|---|---|---|---|---|---|
| 1 | A | 1,137 | 1,100 | 560 | 830 | CGL | 269 | 0.202 | 1.81 | 442 | 7.2 | 0.35 | 0.049 | EXAMPLE |
| 2 | B | 1,324 | 1,090 | 560 | 830 | CGL | 253 | 0.216 | 1.88 | 441 | 7.5 | 0.55 | 0.000 | EXAMPLE |
| 3 | | 1,324 | 1,230 | 560 | 830 | CGL | 257 | 0.212 | 1.86 | 442 | 7.3 | 0.58 | 0.005 | EXAMPLE |
| 4 | | 1,324 | 1,280 | 560 | 830 | CGL | 259 | 0.211 | 1.86 | 443 | 7.1 | 0.50 | 0.020 | EXAMPLE |
| 5 | | 1,324 | 1,230 | 490 | 865 | CGL | 255 | 0.215 | 1.83 | 447 | 6.3 | 0.60 | 0.000 | EXAMPLE |
| 6 | | 1,324 | 1,230 | 495 | 865 | CAL | 257 | 0.213 | 1.98 | 446 | 6.6 | 0.75 | 0.006 | EXAMPLE |
| 7 | C | 1,350 | 1,230 | 560 | 830 | CGL | 264 | 0.207 | 1.96 | 444 | 7.3 | 0.44 | 0.029 | EXAMPLE |
| 8 | D | 1,350 | 1,220 | 560 | 830 | CGL | 269 | 0.203 | 1.94 | 442 | 7.4 | 0.39 | 0.030 | EXAMPLE |
| 9 | E | 1,268 | 1,220 | 620 | 865 | CGL | 169 | 0.219 | 1.90 | 340 | 8.0 | 1.30 | 0.012 | EXAMPLE |
| 10 | F | 1,268 | 1,230 | 580 | 855 | CGL | 205 | 0.217 | 1.87 | 396 | 7.8 | 0.50 | 0.010 | EXAMPLE |
| 11 | | 1,268 | 1,230 | 500 | 720 | BAF | 198 | 0.219 | 1.91 | 397 | 6.5 | 0.45 | 0.006 | EXAMPLE |
| 12 | G | 1,350 | 1,200 | 500 | 865 | CGL | 262 | 0.211 | 1.93 | 451 | 6.4 | 0.25 | 0.040 | EXAMPLE |
| 13 | H | 1,350 | 1,220 | 525 | 800 | CAL | 263 | 0.202 | 1.86 | 446 | 8.1 | 0.37 | 0.008 | EXAMPLE |
| 14 | I | 1,350 | 1,230 | 560 | 830 | CGL | 269 | 0.200 | 1.90 | 441 | 6.2 | 0.32 | 0.010 | EXAMPLE |
| 15 | J | 1,350 | 1,230 | 570 | 850 | CAL | 258 | 0.209 | 2.05 | 444 | 6.9 | 0.52 | 0.027 | EXAMPLE |
| 16 | K | 1,350 | 1,220 | 580 | 855 | CAL | 259 | 0.210 | 2.11 | 446 | 6.7 | 0.41 | 0.014 | EXAMPLE |
| 17 | L | 1,337 | 1,250 | 580 | 850 | CGL | 254 | 0.214 | 1.97 | 444 | 7.4 | 0.49 | 0.000 | EXAMPLE |
| 18 | M | 1,337 | 1,250 | 610 | 850 | CGL | 265 | 0.208 | 1.94 | 448 | 6.5 | 0.38 | 0.000 | EXAMPLE |
| 19 | N | 1,337 | 1,220 | 580 | 855 | CGL | 259 | 0.210 | 1.90 | 446 | 7.0 | 0.42 | 0.008 | EXAMPLE |
| 20 | O | — | 1,220 | 560 | 830 | CGL | 279 | 0.193 | 1.73 | 445 | 7.4 | 0.22 | 0.116 | COMPARATIVE |
| 21 | P | 1,350 | 1,230 | 560 | 830 | CGL | 276 | 0.192 | 1.93 | 444 | 7.5 | 0 | 0.045 | COMPARATIVE |
| 22 | Q | — | 1,230 | 620 | 830 | CGL | 294 | 0.181 | 1.57 | 443 | 11.4 | 0 | 0.010 | CONVENTIONAL |
| 23 | R | 1,286 | 1,220 | 590 | 860 | CGL | 314 | 0.190 | 1.62 | 472 | 6.3 | 0 | 0.064 | COMPARATIVE |
| 24 | S | 1,196 | 1,220 | 560 | 830 | CGL | 302 | 0.193 | 1.78 | 485 | 7.8 | 0.05 | 0.042 | COMPARATIVE |
| 25 | T | 1,236 | 1,220 | 560 | 820 | CGL | 353 | 0.132 | 1.92 | 444 | 4.8 | 0 | 0.055 | COMPARATIVE |

TABLE 2-continued

| SAMPLE NO. | STEEL NO. | {770 + ([sol. Al] − 0.085)$^{0.24}$ × 820} (° C.) ※ | HOT ROLLING CONDITIONS SRT (° C.) | HOT ROLLING CONDITIONS CT (° C.) | ANNEALING CONDITIONS AT (° C.) | ANNEALING CONDITIONS LINE | MECHANICAL PROPERTIES YS (Mpa) | MECHANICAL PROPERTIES $n_{1-10}$ | MECHANICAL PROPERTIES r VALUE | MECHANICAL PROPERTIES TS (Mpa) | GRAIN DIAMETER (μm) | WIDTH OF PFZ (μm) | AREA DENSITY OF Nb (C, N) OF 50 nm OR MORE (/μm$^2$) | REMARKS |
|---|---|---|---|---|---|---|---|---|---|---|---|---|---|---|
| 26 | U | 1,247 | 1,220 | 560 | 830 | CGL | 311 | 0.193 | 1.79 | 482 | 7.6 | 0.08 | 0.053 | COMPARATIVE |
| 27 | V | 1,302 | 1,230 | 560 | 830 | CGL | 320 | 0.160 | 1.25 | 442 | 10.0 | 0 | 0.012 | COMPARATIVE |

UNDERLINED: OUT OF THE PRESENT INVENTION
※A VALUE EXCEEDING 1350° C. IS REGARDED AS 1350° C.

The invention claimed is:

1. A high strength cold rolled steel sheet consisting of 0.004 to 0.02% of C, 1.5% or less of Si, 3% or less of Mn, 0.15% or less of P, 0.02% or less of S, 0.001 to 0.007% of N, 0.03 to 0.2% of Nb, 0.2 to 0.6% of sol.Al by mass, and the balance of Fe and inevitable impurities and composed of ferrite grains having an average grain diameter of 10 μm or less, in which the average number per unit area (hereinafter referred to as "average area density") of Nb(C, N) precipitates having a diameter of 50 nm or more in the ferrite grains is $7.0\times10^{-2}$/μm$^2$ or less, and a zone having a width of 0.2 to 2.4 μm and an average area density of NbC precipitates of 60% or less of that of the central portion of the ferrite grains is formed along grain boundaries of the ferrite grains.

2. The high strength cold roiled steel sheet according to claim 1, wherein the following equation (1) is satisfied;

$$([Nb]/[C])\times(12/93)\geqq1 \quad (1),$$

where [Nb] and [C] represent the amounts of Nb and C (mass %), respectively.

3. The high strength cold roiled steel sheet according to claim 1, further containing 0.0001 to 0.003% of B.

4. The high strength cold rolled steel sheet according to claim 2 further containing 0.0001 to 0.003% of B.

5. The high strength cold rolled steel sheet according to claim 1 further containing at least one element selected from the group consisting of 0.5% or less of Cu, 0.5% or less of Ni, 0.3% or less of Mo, 0.5% or less of Cr, and 0.04% or less of Ti.

6. The high strength cold roiled steel sheet according to claim 1 further containing at least one element selected from the group consisting of 0.5% or less of Cu, 0.5% or less of Ni, 0.3% or less of Mo, 0.5% or less of Cr, and 0.04% or less of Ti.

7. The high strength cold rolled steel sheet according to claim 1 further containing at least one element selected front the group consisting of 0.2% or less of Sb and 0.2% or less of Sn, wherein the following equation (2) is satisfied;

$$0.002\leqq[Sb]+½\times[Sn]\leqq0.2 \quad (2),$$

where [Sb] and [Sn] represent the amounts of Sb and Sn (mass %), respectively.

8. The high strength cold rolled steel sheet according to claim 6 further containing at least one element selected from the group consisting of 0.2% or less of Sb and 0.2% or less of Sn, wherein the following equation (2) is satisfied;

$$0.002\leqq[Sb]+½\times[Sn]\leqq0.2 \quad (2),$$

where [Sb] and [Sn] represent the amounts of Sb and Sn (mass %), respectively.

9. A method for manufacturing a high strength cold rolled steel sheet comprising the steps of:

hot rolling a steel slab having the chemical composition according to claim 1 into a hot rolled steel sheet after heating the steel slab at a heating temperature SRT which satisfies the following equations (3) and (4); and pickling and cold rolling the hot rolled steel sheet, followed, by annealing within a temperature range of a ferrite phase above the recrystallization temperature, $$SRT\leqq1350°\ C. \quad (3)$$

$$1050°\ C.\leqq SRT\leqq\{770+([sol.Al]-0.085)^{0.24}\times820\}°\ C. \quad (4),$$

where [sol.Al] represents the amount of sol.Al (mass %).

10. The high strength cold rolled steel sheet according to claim 1 having an $n_{1-10}$ of 0.20 or more.

11. The high strength cold rolled steel sheet according to claim 1 having a YS of 270 MPa or less.

12. The high strength cold rolled steel sheet of claim 1 having a TS of 340 MPa or more.

* * * * *

UNITED STATES PATENT AND TRADEMARK OFFICE

CERTIFICATE OF CORRECTION

PATENT NO. : 7,608,156 B2
APPLICATION NO. : 10/549164
DATED : October 27, 2009
INVENTOR(S) : Ono et al.

It is certified that error appears in the above-identified patent and that said Letters Patent is hereby corrected as shown below:

In Column 1

At line 13, please change "BACKGROUND ART" to --BACKGROUND--.

In Column 7

At lines 26 through 32, please delete "The coiling temperature after hot rolling has influences on the formation of PFZ and the r value. In order to effectively form the PFZ, fine NbC must be precipitated, and in order to obtain a high r value, the amount of solute C must be sufficiently decreased. In view of the effective formation of PFZ and the high r value, the coiling temperature is preferably set to 480 to 700°C., more preferably 500 to 600°C.".

Signed and Sealed this

Ninth Day of March, 2010

David J. Kappos

David J. Kappos
*Director of the United States Patent and Trademark Office*